US006069704A

United States Patent [19]

Verhaag

[11] Patent Number: 6,069,704

[45] Date of Patent: May 30, 2000

[54] METHOD OF SCHEDULING A SEQUENCE OF PAGES TO BE PRINTED WITH A DUPLEX PRINTER

[75] Inventor: Franciscus J. J. Verhaag, Stramproy, Netherlands

[73] Assignee: Oce-Technologies, B.V., Ma Venlo, Netherlands

[21] Appl. No.: 08/946,927

[22] Filed: Oct. 8, 1997

[30] Foreign Application Priority Data

Oct. 8, 1996 [EP] European Pat. Off. ..... 96202799

[51] Int. Cl.[7] ..... G03G 15/00

[52] U.S. Cl. ..... 358/1.12; 358/1.14; 358/1.01; 271/291; 355/23; 355/24

[58] Field of Search ..... 395/112, 114, 395/101; 271/291; 355/23, 24; 358/1.12, 1.14, 1.01

[56] References Cited

U.S. PATENT DOCUMENTS 4,453,841 6/1984 Bobick et al. ..... 399/401
4,918,490 4/1990 Stemmle ..... 347/16
5,095,342 3/1992 Farrell et al. ..... 355/319
5,504,568 4/1996 Saraswat et al. ..... 399/364

*Primary Examiner*—Mark R. Powell
*Assistant Examiner*—Lance W. Sealey

[57] ABSTRACT

A method of scheduling a sequence of pages to be printed with a printer and a printer/photocopier incorporating this method are disclosed. The printer has a printing station and a duplex loop for returning duplex sheets, of which a first page has been printed on one side, to the printing station for printing the second page on the second side, the duplex loop accommodating a predetermined number N of sheets at a time, such that skips in the stream of pages are filled with first pages of duplex sheets or with simplex sheets, without changing the desired order in which the sheets are completed. When a new print command for printing a new job occurs, the pages of the new job are appended to the remainder of the previously scheduled sequence that has not yet been printed, with re-scheduling of the thus assembled sequence.

14 Claims, 4 Drawing Sheets

METHOD OF SCHEDULING A SEQUENCE OF PAGES TO BE PRINTED WITH A DUPLEX PRINTER

FIELD OF THE INVENTION

The invention relates to a method of scheduling a sequence of pages to be printed with a printer having a duplex loop, and to a printer in which this method is implemented.

BACKGROUND OF THE INVENTION

In a printer having a duplex loop, the duplex sheets on which one page has been printed on one side thereof are continuously passed through the duplex loop in which they are reversed and recirculated to the printing station so that the second page can be printed on the second side. This has the advantage that no intermediate tray is necessary for accommodating the half-completed duplex sheets between the first and second print cycle, so that no limitations as to the capacity of the intermediate tray need to be observed, and the first completed duplex copies are available in the output tray only a short time after the printing operation has started. The duplex loop has a predetermined capacity dependent on the length of the duplex loop and on the size of the sheets.

For example N-sheets of equal size can be present in the duplex loop. The duplex loop may also contain sheets of different sizes. This does not affect the general applicability of the method described herein.

The operation of the printing station in which one complete page is printed on one side of a sheet will be termed "print cycle" hereinafter. The sequence in which the various pages of a document are printed in the printing station must fulfill the condition that there always exists a predetermined distance, dependent on the size of the sheet, between the printing of the first page and the second page on the same sheet. For example, if the capacity of the duplex loop is 5 sheets and a document consists of ten pages to be printed on five duplex sheets, then the second, fourth, sixth, eighth and tenth page may sequentially be printed on the respective first sides of the sheets, and afterwards the first, third, fifth, seventh and ninth page are sequentially printed on the respective second side of each sheet, so that one copy of the whole document can be completed within ten cycles. If the copies are deposited "face down" in the output tray, then a collated set of copies will be obtained, i.e., the order of pages in the stack of copy sheets will be the same as in the original document.

However, if the document has only nine pages, then the fifth sheet would be a simplex sheet which needs not be circulated through the duplex loop. Then, the printing sequence would be 2-4-6-8-skip-1-3-5-7-9. The "skip" in the fifth print cycle is necessary in order to make sure that pages 1 and 2 are printed on the same sheet. Such skips in the printing sequence mean that the printing station is inoperative during certain cycles. This leads to a loss of productivity of the printer, in particular when the above sequence is repeated several times in order to print multiple copies of the document.

Several approaches have been made to increase the productivity of this type of printer by scheduling the sequence of pages such that the number of skips is reduced.

U.S. Pat. No. 5,095,342 discloses a scheduling method according to the preamble of claim 1 which may involve a plurality of print jobs, so that the skips occurring at the end of one job can be filled with the first pages of a subsequent job, of course without changing the order in which the copies are completed. This method also involves the transformation of simplex sheets into duplex sheets, which means that a sheet is treated as a duplex sheet and is circulated through the duplex loop, although one side of this sheet remains empty. In conjunction with the scheduling algorithm disclosed in this document, such transformation of simplex sheets into duplex sheets may under certain conditions lead to a further enhancement of productivity. However, whether these conditions are fulfilled or not can only be determined when the page structure (simplex or duplex) is known beforehand for the totality of jobs involved. As an additional measure for eliminating skips, it is proposed in this document to advance the scheduling of some duplex pages ahead of the last simplex page at a simplex-to-duplex transition, thereby to avoid skips without changing the output order of the sheets.

U.S. Pat. No. 4,453,841 discloses a scheduling method in which the scheduled sequence consists of a predefined string which is then cyclically repeated in accordance with the number of copies to be made. One of a plurality of predefined strings is selected dependent on the number of pages of the job. Thus, this scheduling process also requires that the total number of pages to be printed is known beforehand.

U.S. Pat. No. 4,918,490 discloses a method in which the jobs to be printed are divided into a number of batches, each batch consisting of 2N pages when N is the capacity of the duplex loop. Each batch is sequenced in the manner described in the opening paragraphs of the present description. Depending on the number of pages per job, there may still remain a considerable number of skips which lead to production losses when the number of copies to be made is large. According to another method discussed in the same document, the pages are sequenced such that skips will occur only during the first N cycles and the last N cycles of the sequence but not in the middle part thereof. This method also has a comparatively low efficiency when the number of pages per job is small and a large number of copies has to be made.

SUMMARY OF THE INVENTION

It is an object of the invention to provide a more efficient method of scheduling a sequence of pages to be printed with a printer having a duplex loop.

According to the invention, this object is achieved by a method of scheduling a sequence of sheets to be printed, including duplex sheets, wherein a new print command for printing a new job occurs, the pages of the new job are appended to the remainder of the previously scheduled sequence that has not yet been printed, with re-scheduling of the thus assembled sequence.

Thus, the method according to the invention is applicable even when the total number of pages to be printed is not yet known at the instant when the scheduling process starts. It is accordingly possible to enter a print command for a new job when the previous jobs have already been scheduled, but the printer has not yet completed the previous job(s). Then, the new job will be combined with the previous job or at least with the remainder of the previous job that has not yet been printed, and the sequence is optimized by re-scheduling the totality of pages still to be printed, starting from the already scheduled previous sequence and the new pages appended thereto. As a result, the operation of the printer will generally be more efficient than in the case when the previous jobs are completed on the basis of the previously scheduled sequence and the new job is scheduled independently thereof.

New jobs may be entered as desired and with an arbitrary order of duplex and simplex pages and with arbitrary formats, and the scheduled sequence will continuously be actualized.

In the remainder of the description scheduling of sheets of equal sizes will be described. It will be obvious to a person skilled in the art to extend the teaching to scheduling of sheets of arbitrary formats.

The sequence of sheets to be printed according to the method of the invention may be built-up by adding new pages sheet-by-sheet in the order in which the sheets are to be output. When a duplex sheet is added, the distance between the printing of the first page of the sheet and the second page of said sheet is determined, hereafter called the predetermined distance, then this pair positioned such that, whenever possible, the first page thereof fits into a skip of the previous sequence. In the case that the position of the first page of the appended duplex sheet is occupied by a simplex page and at least one skip is present between this simplex sheet and a neighboring second page of a duplex sheet, the simplex page is shifted to the position of the skip, so that the first page of the new duplex sheet can be placed at the former position of the simplex sheet. Thus, the re-scheduling of the previous sequence will only affect the trailing part of this sequence. Accordingly, since the leading part of the sequence is not altered, the printing operation may be controlled on the basis of the leading part of the sequence while the trailing part of the sequence is continuously being supplemented and re-scheduled.

In a particularly preferred embodiment, the scheduling process comprises a second stage in which the sequence is optimized further and which is performed when the first stage (pre-scheduling) for the last job has been completed and no new print command has been entered in the meantime. In the second stage, the skips still present in the sequence are successively eliminated, starting with the trailing end of the pre-scheduled sequence. This second stage of the scheduling process is continued either until it reaches the position of the page which is already being printed (i.e., the leading end of the sequence) or until a new print command occurs and the pre-scheduling process is resumed for the new job, whichever event occurs earlier. In this case, an intermediate optimized result is used, as a starting point for the new pre-scheduling. As long as the scheduling process can keep up with the new jobs being entered, the sequence will always be optimized in that it contains a smallest possible number of skips. On the other hand, if the new print commands are entered at such a high rate or the new jobs are so complex that the scheduling processor is overloaded, it is not necessary to interrupt the operation of the printer, and the only effect is that the printer operates with the intermediate sequence in place of the optimized final sequence.

The term "printer" as used in the present application is intended to comprise any device which is capable of producing hard copies of documents and in which the print order of the pages can be varied, including for example digital copiers with storage capacity for image information of a plurality of pages.

The foregoing and other objectives of the present invention will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE PREFERRED EMBODIMENTS

Figure 1:
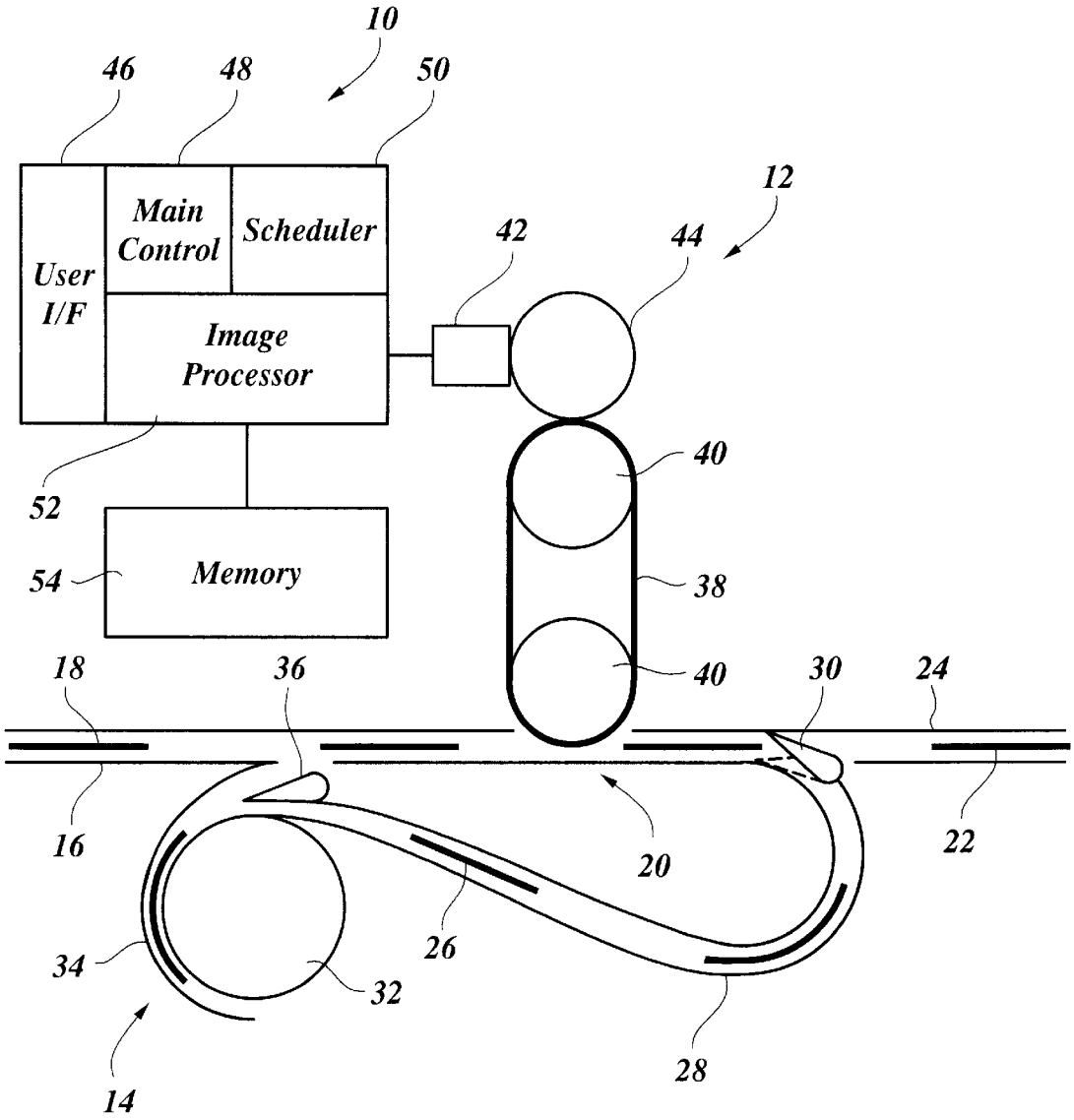
FIG. 1 is a diagram of a printer to which the invention is applicable.

As is shown in FIG. 1, a printer generally comprises a control section 10, an image forming section 12 and a paper handling section 14. The general construction of such a printer being well known in the art, only those parts of the printer will be described in detail which are essential for the present invention.

The paper handling section 14 comprises a copy sheet supply path 16 through which copy sheets 18 are supplied from a copy sheet feed system (not shown) to a printing station 20 under the control of the control section 10. Completed duplex or simplex copies are discharged via an output path 24 into an output tray (not shown).

Duplex sheets 26, on which an image of a first page has been printed on one side in the printing station 20, are deflected into a duplex loop 28 by a deflector 30. The duplex loop 28 is equipped with sheet transport mechanisms such as feed rollers or the like (not shown) and has a reversing drum 32 and a reversing guide 34 in which the sheets 26 are reversed, so that they may be recirculated to the printing station 20 via a deflector 36 in such an orientation that image information of a second page can be printed on the second side of the sheet, whereafter the completed copies will be discharged through the output path 24. Simplex sheets having an image only on the first side will be guided directly to the output path 24 by switching the deflector 30 into the position shown in phantom lines.

As is shown in the drawing, the duplex loop 28 has a capacity of 5 sheets, i.e., it accommodates five sheets 26 at a time. As a consequence, when the sheets are supplied to the printing station 20 in constant time intervals, one print cycle being performed in each time interval, and a first page has been printed on one side of a duplex sheet 26, then the second page will be printed on the second side of the same duplex sheet five print cycles later.

In the shown example, the image forming section 12 is of an electrographic, magnetographic or electrophotographic type having an intermediate image carrier 38 in the form of an endless belt wound around two rollers 40. An image forming unit 42 is provided for creating a toner image on the surface of a primary image carrier 44 (i.e., a drum) in accordance with image information received from the control section 10. The toner image is then transferred from the primary image carrier 44 to the intermediate image carrier 38 and is then fuse-transferred to the copy sheet in the printing station 20 which is therefore also termed "image transfer station" in the present embodiment.

The control section 10 comprises a front end system (or user interface) 46, a main control unit 48 including a scheduler 50, and an image processing unit 52 associated with a multi-page memory 54.

Image information and printing instructions from the user are input via the front end system 46. The image information is processed in the image processing unit 52 and is stored page-wise in the memory 54. Under the control of the main control unit 48 and the scheduler 50, the image information is retrieved from the memory 54 and is supplied to the image forming unit 42 in timed relation with the operation of the image forming section 12 and the paper handling section 14.

The control section 10 may be programmed to carry out a number of print jobs one after the other without stopping the primary image carrier 44 and the intermediate image carrier 38 in-between. Each job may consist of a plurality of simplex and duplex sheets in arbitrary order. The number of copies to be made can be specified individually for each job.

The terms "first page" and "second page" as used herein in conjunction with the duplex sheets 26 do not necessarily correspond to the numbering of the pages in the various jobs, but simply refer to the order in which the images are printed on the opposite sides of the sheet.

It is desirable that the copies are printed and discharged in such a manner that a collated stack of sheets is obtained in the output tray. For example, if the printed copies 22 shown in FIG. 1 are dropped into the output tray without being reversed, and the first page of a document is also the first page to be printed, then it is convenient that page 1 of the document and all odd numbered pages of the document are positioned on the bottom sides of the sheets and all even numbered pages are positioned on the top sides of the sheets so that the sheets are discharged "face down". In this case, the first page of a document would actually be the "first page" of the duplex sheet 26, and the second page of the document would be the "second page" of the sheet 26, i.e., the page that is printed five cycles later.

When scheduling the sequence in which the image information of the pages is supplied to the image forming unit 42 and then printed onto the various sheets, it must be assured that there exists the predetermined distance between the first page and the second page to be printed on the same duplex sheet 26. In addition, the order of simplex sheets and second pages of duplex sheets in the sequence must not be altered in comparison to the original job, when collated copies are to be obtained. The pages on simplex sheets and the second pages on duplex sheets will be designated "output pages" hereinafter, because they determine the order in which the sheets are discharged through the discharge path 24.

The scheduling process according to the invention will now be described in detail in conjunction with FIGS. 2 and 3. As an example, it will be assumed that the job to be scheduled consists of printing eight duplex copies of a seven page document. Further, it is assumed that all previous jobs have been completed already, so that the scheduling process starts with an "empty" sequence.

The sequence is built-up sheet-by-sheet. FIGS. 2 and 3 illustrate the development of the sequence as the scheduling proceeds. Each line represents the status of the sequence at a given instant. A first page of a duplex sheet is represented by a solid black rectangle. A second page of a duplex sheet is represented by a hatched rectangle. Thus, a complete duplex sheet consists of a solid and a hatched rectangle at the predetermined distance which for the given format results in a capacity of 5 sheets, as is shown in line 1 in FIG. 2. A simplex page, i.e., the single page of a simplex sheet, is represented by a white rectangle.

Figure 2:
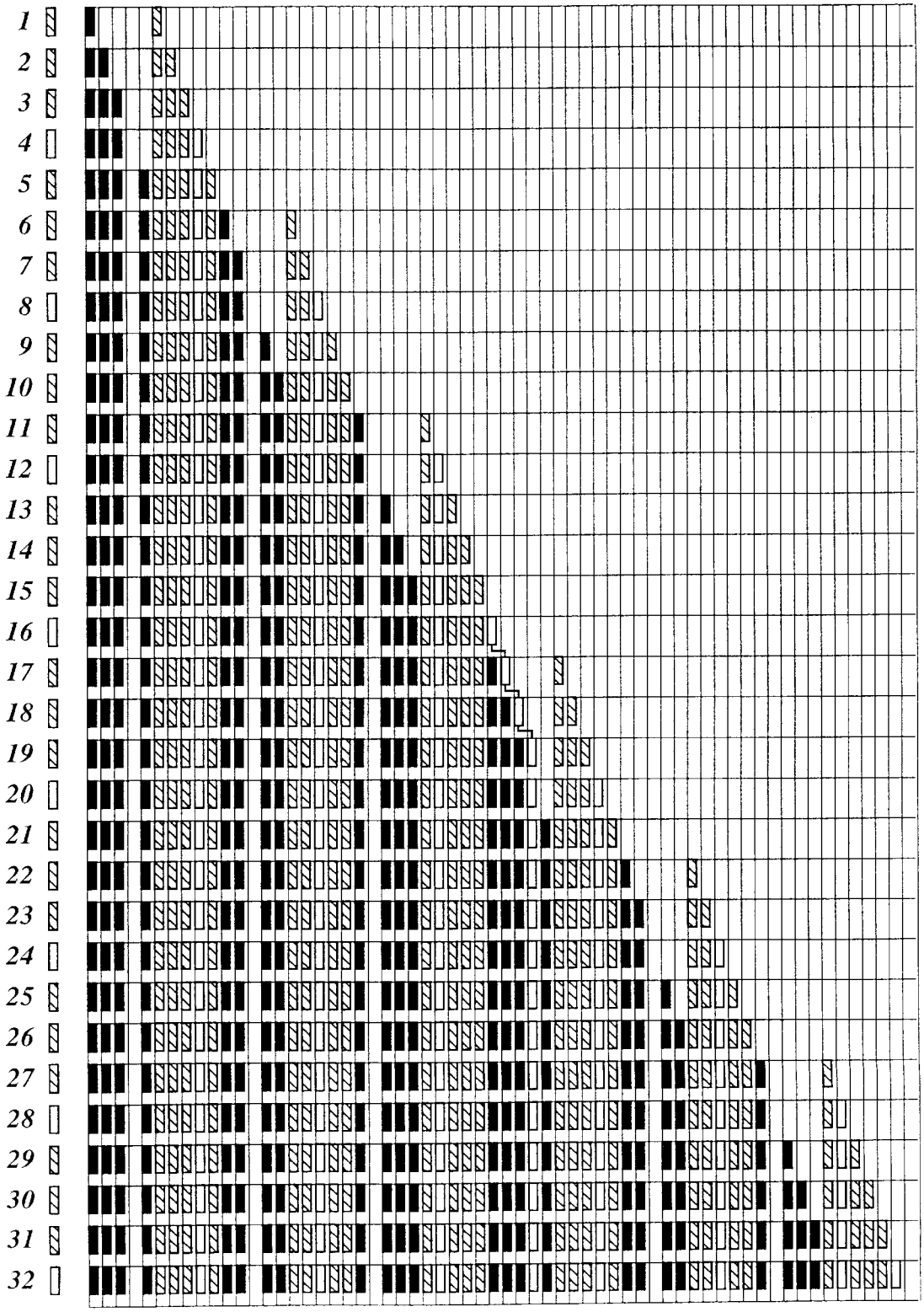
FIG. 2 is a diagram illustrating a pre-scheduling operation.

The column of rectangles on the left margin in FIG. 2 represents the order of the output sheets, i.e., the second duplex pages and simplex pages.

Starting with the empty sequence a first sheet is added, by determining the predetermined distance between the first and the second page of this first duplex sheet. Then the string describing the behavior of this first sheet will become the start of the new sequence. The second sheet is treated similarly. First the predetermined distance of this sheet is determined. Then the separate string describing the behavior of the second sheet is appended to the sequence.

In line 2, the second duplex sheet has been appended to the sequence. The output page, i.e., the second page of second sheet has been placed immediately behind the output page of the first sheet. The first page of the second sheet fits in the gap between the pages of the first sheet. In line 3, the third duplex sheet of the first copy has been appended in the same manner. In line 4, the simplex page has been placed immediately behind the previous output page.

When, then, the first duplex sheet of the second copy is appended as in line 5, it can be seen that the first page thereof still fits in the gap between the pages of the first sheet. However, when appending the next sheet in line 6, it is not possible to place the new output page immediately behind the previous output page, because then the position for the first page of the new sheet would be occupied already. For this reason, the pages of the new sheet have been successively shifted several steps to the right, until an empty space for the first page has been found (in this case behind the last output page of the previous sequence). The size of the steps of the shifting being determined by the size of the duplex loop and the formats of the sheets in that loop.

The subsequent pages are appended in an analogous way, as is illustrated in lines 8 to 16.

A special situation occurs in the step illustrated in line 17. In the previous sequence illustrated in line 16, all positions preceding the last simplex sheet are occupied already, so that the first page of the next sheet would normally have to be placed behind the last simplex sheet. However, since the positions of simplex pages and duplex first pages can be interchanged without altering the order of output pages, the last simplex page has been shifted one position to the right, as is indicated by an angled black line between steps 16 and 17. This simplex page can also be shifted directly to the position just before the next output page. Thus, a skip occurs between the last simplex page and the preceding output page. The new sheet is placed in such a position that skip is filled by the first page of the new sheet.

An analogous procedure has been applied in the next steps, lines 18 and 19. It is observed that, in these steps, the number of skips is reduced by re-scheduling the previous sequence, i.e., by shifting the last simplex page. A next page, line 21, can be appended without shifting a simplex page, because the first page of the new sheet readily fits in the last skip of the previous sequence.

Lines 22 to 32 illustrate how the sequence is completed page-by-page, utilizing the procedures for appending new pages, possibly with re-scheduling of the old sequence as described above.

As is shown in line 32, the final sequence for this individual job comprises 32 pages to be printed with only five skips intervening therebetween, which is quite a reasonable result. The printing process could now be started, so that the pages are printed one after the other as scheduled. If a new print command is entered and, accordingly, a new job has to be scheduled before the printing of the previous job has been completed (or even before it has started), the pages of the new job can simply be appended to the existing sequence page-by-page, utilizing the same procedures as described above. Thus, the scheduling method according to the invention is suitable for continuous scheduling "on the fly", as the printing commands come in, and it is not necessary to divide the jobs entered so far into separate units which are scheduled independently from one another. Thanks to this feature, the process according to the invention avoids additional skips which would inevitably occur at the boundaries between the independent units.

It has been found however that the result of the above-described scheduling process can be optimized further. This is why, in the present example, the process described above represents only the first stage of the total scheduling procedure. This first stage will be termed "pre-scheduling" hereinafter.

Figure 3:
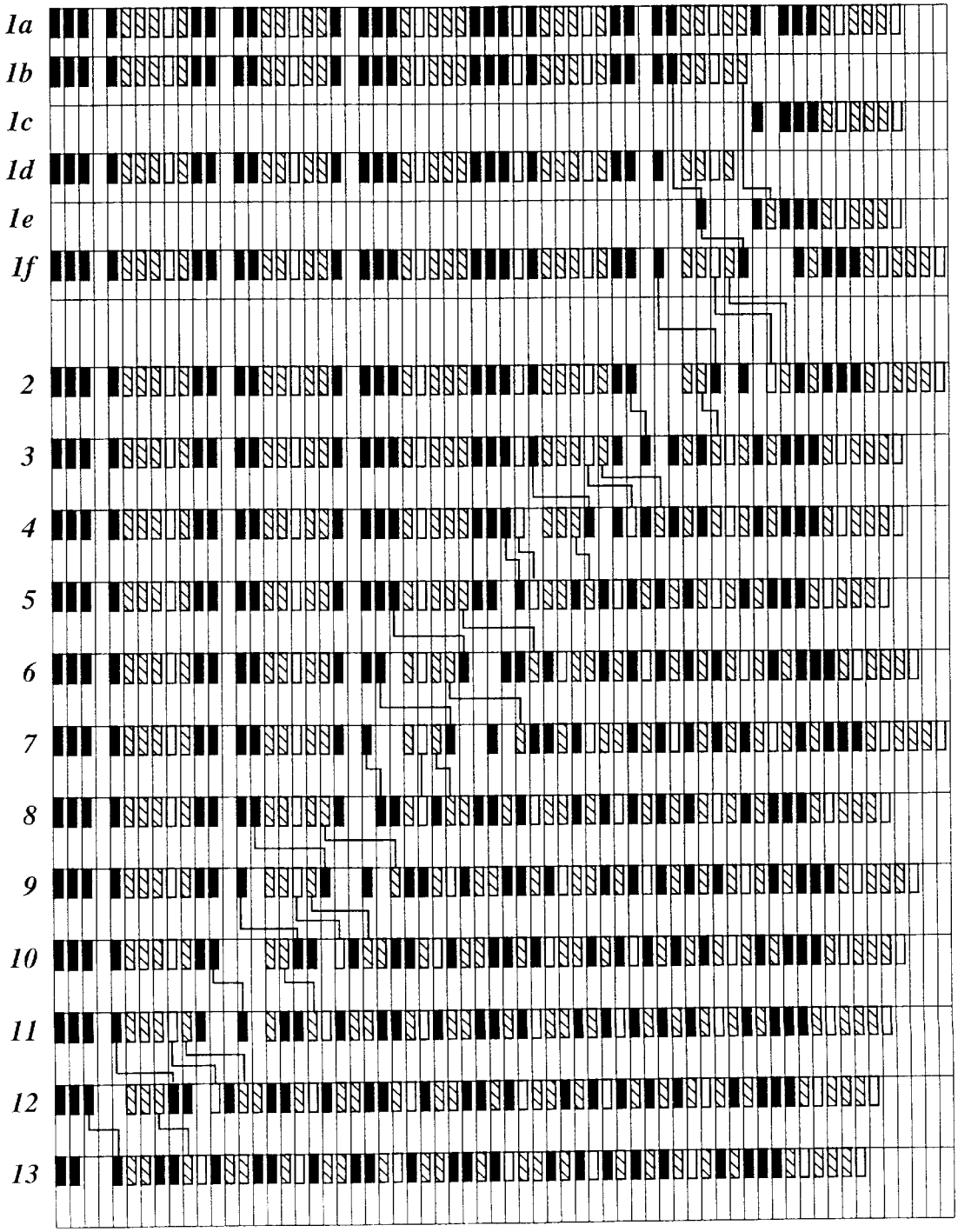
FIG. 3 is a diagram illustrating a second stage of a scheduling operation.

The second stage is illustrated in FIG. 3. While the pre-scheduling proceeds in forward direction in the order of the output sheets, the optimizing procedure in the second stage is performed in rearward direction, from the trailing end towards the leading end of the sequence. In each step, the last skip in the sequence is eliminated.

The first step is illustrated in greater detail in lines 1*a* to 1*b* in FIG. 3.

Line 1*a* is identical with line 32 in FIG. 2. This sequence is split at the position of the last skip, so that two separate strings are obtained as is illustrated in FIGS. 1*b* and 1*c*. The first string ends with the last output page (i.e., completed sheet) before the skip, and the second string starts with the first page of a sheet positioned behind the skip. The second string, line 1*c*, will always contain at least a single skip, i.e., the last skip of the original sequence.

Then, as is illustrated in lines 1*d* and 1*e*, the last sheet of the first string is transferred to the second string, and the output or second page is inserted into the skip of the second string, thereby eliminating this skip. However, as can be seen in line 1*e*, new skips are produced at the leading end of this string. The second string thus consists of a "tail" which is free of skips, and a "head" which contains first duplex pages and skips.

Then, as is shown in line 1*f*, the two strings are re-assembled or "spliced". The purpose of this reassembly or "splicing" is to get an intermediate result, which can be compared to previous results in order to get the shortest sequence at every step in the optimizing process.

This splicing operation is analogous to the step of appending a new sheet in the pre-scheduling process. It is attempted to place the tail as close as possible to the last page of the first string. To this end, the first page of the tail (generally a first duplex page) is placed immediately behind the last page of the first string, and it is checked whether the head of the second string fits into the skips of the first string. If not, the second string is shifted one position to the right and the check is repeated. This procedure is iterated until the head of the second string fits into the first string. In the example shown in line 1*f*, the second string must simply be appended behind the first string.

It is observed that the result of this step does not necessarily lead to an improvement. As indicated before intermediate results to get the shortest sequence are stored in the control section 10. In fact, the string in line 1*f* is longer and has more skips than the original string in line 1*a*. However, what is important is that the skip-free tail has become larger, which is beneficial because it can lead to shorter sequences when the optimization is continued.

The procedure illustrated in lines 1*a* to 1*f* is then iterated. Lines 2, 3, . . . only show the respective results of these iterating steps, and the important changes are indicated by angled lines.

Comparing lines 1*f* and 2, it is observed that the last output page of the first string (a duplex second page) has been shifted to the last skip. In addition, in conjunction with the splicing of the two strings, the last simplex page of the first string has also been shifted to the rightmost skip in the interval between the original position of this simplex page and the next output page. As has been mentioned before, such a shift is possible because the order of simplex sheets and duplex first sheets may be changed without altering the sequence of output pages.

In the transition from line 2 to line 3, the first page of the shifted duplex sheet fits into a skip of the first string, so that the sequence becomes shorter.

The transitions from lines 3 to 4 and 4 to 5 correspond to the transition from line 1*f* to line 2. The steps illustrated in lines 6 and 7 are straightforward. The transition from line 7 to line 8 actually consists of two steps. In a first step, the last duplex second page of the first string is shifted to the last skip. This leaves a new skip immediately behind the last simplex page in the first string. This simplex page is simply shifted to the right in the second step. Such shifting of a simplex sheet is always performed when a skip is present in the interval between the simplex page and the next output page (i.e., completed sheet). The same situation occurs in the transition from line 9 to line 10 and again in the transition from line 11 to line 12.

Considering how the sequence develops from line 1*a* to line 13, it can be seen that the skip-free tail becomes increasingly larger and the leading part of the sequence which still includes skips successively shrinks to an inevitable remainder of only two skips in line 13. The sequence according to line 13 therefore reflects an optimum for the given job.

When line 13 has been reached, the optimizing process ends because splitting of the sequence at the last skip would not leave any first string.

In the given example, it has been assumed that the printing of the first document page is not completed before both stages of the scheduling process are accomplished. It might however be possible that one or more pages of the document are printed already before the scheduling is completed. In this case, the printed pages are marked as not shiftable.

If a new print command occurs before the scheduling process is completed, pre-scheduling is resumed for appending the pages of the new job to the intermediate result. Then, of course, it would not make sense to continue with the optimizing stage, because new skips will appear at the end of the sequence. For this reason, the optimizing stage is interrupted and is started again at the end of the overall sequence after the pre-scheduling has been accomplished. Thus, even the optimizing stage of the scheduling process can be performed "on the fly", in spite of incoming new printing commands.

Figure 4:
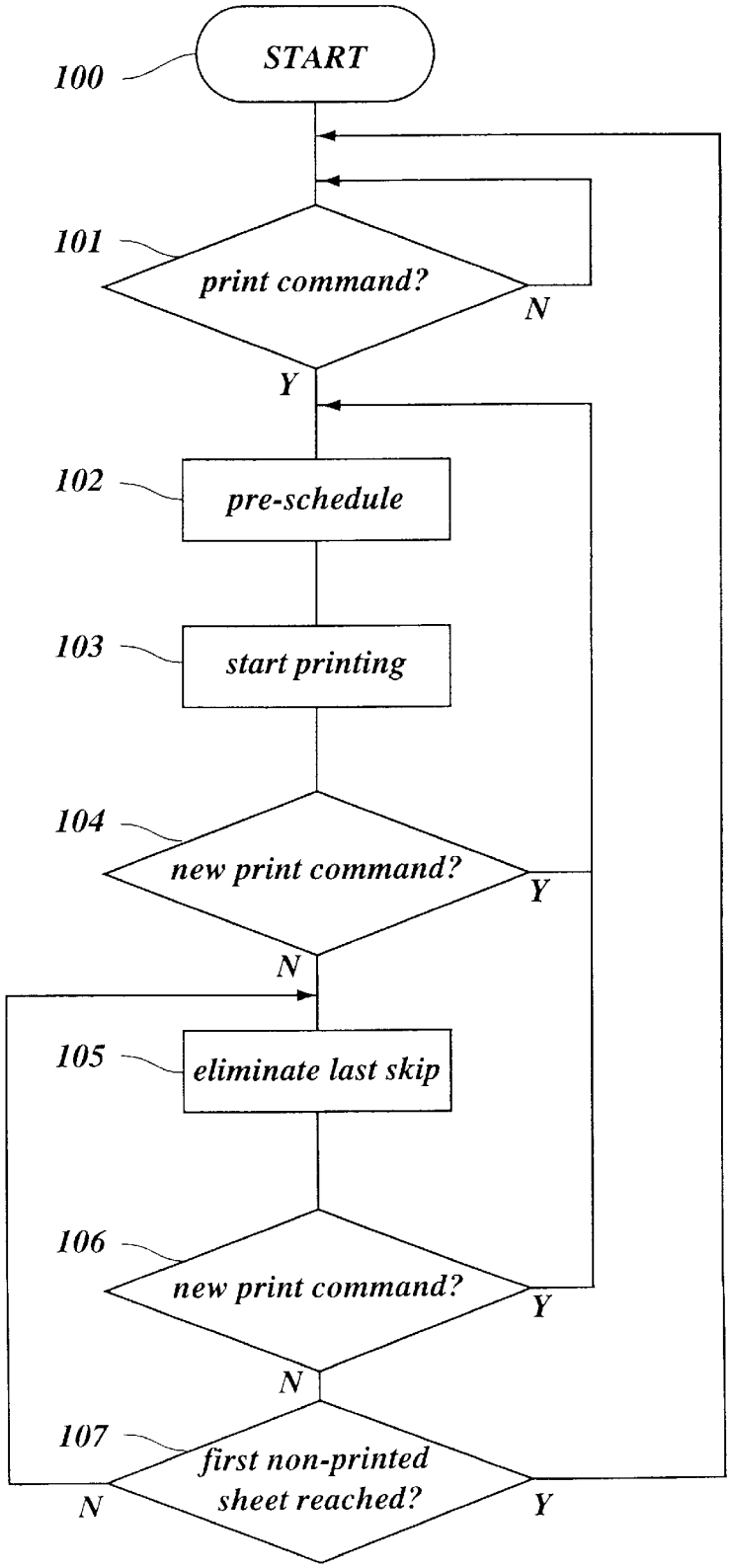
FIG. 4 is a flow chart of the method according to the invention.

The overall procedure is illustrated by the flow chart in FIG. 4.

The scheduling routine performed by the scheduler 50 in FIG. 1 starts at step 100 when the printer is switched on.

Step 101 is a loop in which it is checked whether a print command has been entered. As soon as a print command occurs, the routine proceeds to step 102 where the job associated with this print command is pre-scheduled in accordance with the process illustrated in FIG. 2.

In the shown example, the printing process is started in step 103 as soon as the pre-scheduling for the first job is completed. This means that the data for the first page to be printed are assembled in the image processing unit 52, but it may still take some time until the data will actually be transmitted to the image forming unit 42. It is therefore possible that the complete scheduling process is accomplished already before the first print cycle actually starts. On the other hand, as soon as the print cycle for the first page has started, this page is removed from the leading end of the sequence.

In the subsequent step 104, it is again checked whether a new print command has been entered. If this is the case, the process returns to step 102, and the pages of the new job are appended to the existing sequence in the pre-scheduling mode. Of course, step 103 is skipped, if the printer is operative already.

If it is found in step 104 that no new print command has been entered, then the second stage of the scheduling process is performed. In step 105, the first step of this optimizing procedure is executed, i.e., the last skip of the sequence is eliminated as has been illustrated in FIG. 3.

Then, it is again checked in step 106 whether a new print command has been entered. If so, the optimizing process is interrupted and the routine returns to step 102 for appending the pages of the new job to the existing sequence in the pre-scheduling mode. Otherwise, it is checked in step 107 whether the optimizing process has been completed, i.e., whether the first non-printed sheet has been reached. If this is not the case, then the routine loops to step 105, so that the optimizing process is continued. Otherwise, the routine returns to step 101 and waits for a new print command.

The first non-printed sheet has been reached if the last output page before the skip, which would be the next processed sheet, has already started printing.

It will also be understood that, according to a modified aspect of the invention, the scheduling process explained in conjunction with FIGS. 2 and 3 may be performed in a batch mode, i.e., in a mode in which the scheduling process, once it has started, is completed with the print jobs then available, without interrupting the scheduling process and appending new pages when a new print command is entered.

In another modified aspect of the invention, the scheduling process explained in conjunction with FIGS. 2 and 3 can be performed only when the print command is given to the print engine, if the speed of the control section is not a problem. Then there is sufficient time, after the print command has been given and before the print engine actually starts, to perform the prescheduling and optimizing processes.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A method of scheduling a sequence of pages to be printed with a printer, said printer having a printing station and a duplex loop for returning duplex sheets, of which a first page has been printed on one side, to the printing station for printing the second page on the second side, said duplex loop having a capacity to accommodate a predetermined number—N of sheets at a time, where N is a positive integer, the method comprising the steps of:

filling skips in a stream of pages with first pages of duplex sheets or with simplex sheets, without changing a desired order in which the sheets are to be completed to produce an existing sequence;

appending, when a new print command for printing a new job occurs, pages of said new job to a remainder of the previously scheduled sequence that has not yet been printed to modify the existing sequence; and repeating, after said step of appending, said step of filling skips with the existing sequences being treated as the stream of pages;

wherein said step of repeating said step of filling skips adds pages of new sheets to be printed to the existing sequence sheet-by-sheet according to a modified order of output pages, an output page being defined to be either a page of a simplex sheet or a second page of a duplex sheet; and wherein said step of adding comprises:

(a) placing an output page of a new sheet immediately behind the last output page of the existing sequence, (b) checking, if the new sheet is a duplex sheet, whether the first page thereof fits into a skip of the existing sequence, (c) checking, if the step (b) fails, whether a position of said first page is occupied by a simplex sheet, and if so if a skip is present between the simplex sheet and the last output page before the simplex sheet or the first output page behind the simplex sheet, then shifting the simplex sheet to replace the skip, (d) shifting, if the step (c) fails, both pages of the new duplex sheet a position towards the rear end of the sequence, and (e) repeating the steps (b) to (d) cyclically until one of the steps (b) and (c) is successful.

2. The method according to claim 1, further comprising the step of optimizing a result of the step of adding by rearranging the existing sequence to eliminate skips.

3. The method according to claim 2, further comprising the steps of:

interrupting, when a new print command occurs during the step of optimizing, the step of optimizing; and repeating the step of adding to add the sheets of the new job to the existing sequence.

4. The method according to claim 2, wherein the step of optimizing eliminates skips by beginning at the rear end and proceeding to the front end of the existing sequence.

5. The method according to claim 4, wherein the step of optimizing shifts the last simplex page before the skip to replace the skip so long as no other output pages are present between the simplex page and the skip.

6. The method according to claim 4, wherein the step of optimizing comprises the steps of:

(f) splitting the existing sequence into two strings, the first string having all sheets the output page of which is located before the last skip and the second string having all sheets the output page of which is located behind the last skip;

(g) moving the last sheet of the first string to the second string such that the output page of the moved sheet replaces the skip; and (h) splicing the second string to the first one with greatest possible overlap by fitting the leading duplex first pages of the second string into skips of the first string.

7. The method according to claim 6, wherein the step (h) comprises the substeps of:

(h1) superposing the second string on the first string so that the last skip of the second string coincides with the last page of the first string;

(h2) checking whether the pages of the second string before the last skip thereof fit into skips of the first string;

(h3) checking, if step (h2) fails, whether a position of a page of the second string is occupied by a simplex page in the first string and whether a skip is present between this simplex page and the next subsequent output page, and, if so then shifting the simplex page to the skip and repeating the step (h2);

(h4) shifting, if neither of the steps (h2) and (h3) is successful, the second string one position to the rear and repeating the steps (h2) to (h4) until one of the steps (h2) and (h3) is successful.

8. A printer comprising:

a printing station;

a duplex loop for returning duplex sheets, on which a first page has been printed on one side, to the printing station for printing the second page on the second side, said duplex loop having a capacity to accommodate a predetermined number (N) of sheets at a time, where N is a positive integer; and a controller for controlling the printing station and the duplex loop, said controller being for scheduling a sequence of pages to be printed with said printing station, the controller being operable to fill skips in a stream of pages with first pages of duplex sheets or with simplex sheets, without changing a desired order in which the sheets are to be completed to produce an existing sequence, append, when a new print command for printing a new job occurs, pages of said new job to a reminder of the previously schedule sequence that has not yet been printed to modify the existing sequence, and repeat, after the operation of appending, the operation to fill skips with the existing sequence being treated as the stream of pages;

wherein said controller is operable to add pages of new sheets to be printed to the existing sequence sheet-by-sheet according to a modified order of output pages, an output page being defined to be either a page of a simplex sheet or a second page of a duplex sheet; and wherein said controller is further operable to:

(a) place an output page of a new sheet immediately behind the last output page of the existing sequence, (b) check, if the new sheet is a duplex sheet, whether the first page thereof fits into a skip of the existing sequence, (c) check, if the operation (b) fails, whether a position of said first page is occupied by a simplex sheet, and if so if a skip is present between the simplex sheet and the last output page before the simplex sheet or the first output page behind the simplex sheet, then shifting the simplex sheet to replace the skip, (d) shift, if the operation (c) fails, both pages of the new duplex sheet a position towards the rear end of the sequence, and (e) repeat the operations (b) to (d) cyclically until one of the operations (b) and (c) is successful.

9. The printer according to claim 8, wherein the controller is operable to optimize a result of the operation to add pages of new sheets of be printed by rearranging the existing sequence to eliminate skips.

10. The printer according to claim 9, wherein the controller is operable to:

interrupt the operation to optimize when a new print command occurs during the operation to optimize; and repeat the operation to add pages of new sheets so as to add the sheets of the new job to the existing sequence.

11. The printer according to claim 9, wherein the controller is operable to sequentially eliminate skips by beginning at the rear end and proceeding to the front end of the existing sequence.

12. The printer according to claim 11, wherein the controller is operable to shift the last simplex page before the skip and so replace the skip so long as no other output pages are present between the simplex page and the skip.

13. The printer according to claim 11, wherein the controller is operable to:

(f) split the existing sequence into two strings, the first string having all sheets the output page of which is located before the last skip and the second string having all sheets the output page of which is located behind the last skip;

(g) move the last sheet of the first string to the second string such that the output page of the moved sheet replaces the skip; and (h) splice the second string to the first one with greatest possible overlap by fitting the leading duplex first pages of the second string into skips of the first string.

14. The printer according to claim 13, wherein the controller is operable to:

(h1) superpose the second string on the first string so that the last skip of the second string coincides with the last page of the first string;

(h2) check whether the pages of the second string before the last skip thereof fit into skips of the first string;

(h3) check, if the operation (h2) fails, whether a position of a page of the second string is occupied by a simplex page in the first string and whether a skip is present between this simplex page and the next subsequent output page, and, if so then to shift the simplex page to the skip and to repeat the operation (h2);

(h4) shift, if neither of the operations (h2) and (h3) is successful, the second string one position to the rear and to repeat the operations (h2) to (h4) until one of the operations (h2) and (h3) is successful.

* * * * *